United States Patent [19]

Reed

[11] Patent Number: 4,863,310

[45] Date of Patent: Sep. 5, 1989

[54] PAVING APPARATUS

[76] Inventor: Jeffrey Reed, P.O. Box 26132, Sacramento, Calif. 95826

[21] Appl. No.: 255,479

[22] Filed: Oct. 11, 1988

[51] Int. Cl.[4] ..... E01C 19/00

[52] U.S. Cl. ..... 404/104; 404/105

[58] Field of Search ..... 404/101, 102, 104, 105, 404/106, 108, 110

[56] References Cited

U.S. PATENT DOCUMENTS

| | | | |
|---|---|---|---|
| 2,215,455 | 9/1940 | Abernathy | 404/96 |
| 2,449,710 | 9/1948 | Miller | 404/119 |
| 4,268,187 | 5/1981 | Krause et al. | 404/118 |

FOREIGN PATENT DOCUMENTS

| | | | |
|---|---|---|---|
| 2621558 | 12/1977 | Fed. Rep. of Germany | 404/104 |

*Primary Examiner*—Jerome W. Massie
*Assistant Examiner*—Gay Ann Spahn
*Attorney, Agent, or Firm*—Bielen & Peterson

[57] ABSTRACT

A road shoulder paving box, movable along a surface to be covered with paving material including carriage. The carriage rolls or skids along the surface to be paved and provides a receiver for accepting and holding paving material. The carriage also includes a container supported by the carriage having a chamber formed by a base and side wall portion. Such chamber includes an entrance and exit, as well as a movable partition for changing the volumetric capacity and the dimension of the chamber exit. The receiver and chamber are connected on the carriage of the paving apparatus such that paving material is transported or augered from the container to the receiver chamber.

10 Claims, 3 Drawing Sheets

PAVING APPARATUS

BACKGROUND OF THE INVENTION

The present invention relates to a novel paving apparatus which is especially useful in paving shoulders of roadways.

Paving of hard surfaces often requires the laying of asphalt, concrete and the like on the periphery or shoulder. Such a paving process usually entails a two step method in that the shoulder is paved first and the adjacent roadway second. In the past devices such as the apparatus described in the U.S. Pat. No. 4,268,187 have been employed. Although such prior art apparatuses have satisfactorily screeded or leveled the upper surface of the paving compositions, the edge often extends over the adjacent the roadway. Thus, a lap joint is formed between the paved roadway and the paved shoulder which is not acceptable for use with large aggregate asphalt compounds. Lap joints tend to bleed to the surface causing a slippage hazard to vehicles. Also, such bleeding detracts from the appearance of the roadway. To complicate matters, the shoulders of roadways are often of varying widths. In the past, the edge of the shoulder pavement has been aligned manually or with make-shift panels on conventional pavement boxes. With the latter method any change in shoulder width required jacking of the pavement box for movement of the panel. Such methods are wasteful of labor and material.

A paving apparatus which solves the problems encountered in the prior art would be great advance in the construction industry.

SUMMARY OF THE INVENTION

In accordance with the present invention a novel and useful paving apparatus which lays paving composition on the shoulder for abutment with paving composition on the roadway proper is provided.

The apparatus of the present invention utilizes a carriage which has a lower surface being capable of rolling or skidding relative to the surface to be paved. Typically, the carriage is dragged along the surface to be paved by a vehicle carrying paving material. The carriage is generally ruggedly constructed and includes a receiver for accepting and holding paving material. The receiver may take the form of a hopper or other open funnel-like structures.

Material is placed in the receiver or hopper and is then transported to a container. An auger may be placed in the receiver to transport material therefrom to the container. A motor may be employed to motivate the auger, in this regard. Such container possesses a base portion and side wall portion to form an open chamber. The chamber has an entrance and exit, the former being in communication with the receiver.

Means is also provided for moving a portion of the side wall forming the chamber to change the volumetric capacity of the chamber and to change a dimension of the exit from the chamber. In other words, the width of the paving material exiting the chamber onto the road shoulder of the roadway possesses a predetermined width. Such means may include a partition which moves within the container and threadingly engages a threaded lead screw spanning a portion of the carriage. Again, a motor may be employed to rotate the lead screw and thus move the partition across the container forming the variable width chamber exit of the chamber. Guides may be employed to smoothly move such partition within the container. Such guides would also span the carriage, generally parallel to the lead screw heretofore described.

The apparatus of the present invention also includes means for regulating the height of paving material exiting the chamber, the width of which is fixed by the movable partition. Such means may take the form of a skimmer or screed plate which is placed immediately adjacent the exit of the container chamber. The screed plate adjusts upwardly and downwardly to regulate the thickness of the material placed atop the surface being paved.

In addition, means may also be employed to determine the surface characteristics of the paving material. A flexible plate is positioned to press downwardly on the upper surface of the paving material passing beneath the screed plate. The flexible plate possesses means for adjusting the downward pressure of the same. Both the screed plate and the flexible plate include manual adjustments which are accessible from the top of the carriage. In this regard, the carriage includes a platform permitting the operator to ride on the carriage during the paving process in order to observe the shoulder paving process and to make adjustments to the width, thickness, and quality of the upper surface of the paving material laid by the apparatus of the present invention.

It may be apparent that a novel and useful paving apparatus has been described.

It is therefore an object of the present invention to provide a movable paving apparatus which continuously easily adjusts the width of the strip of paving material being laid on the surface to permit an eventual butt joint between the shoulder area and the main roadway area of a highway.

Another object of the present invention is to provide a paving apparatus which greatly reduces labor and the waste of the material involved in paving a shoulder on a roadway to acceptable standards using prior art methods.

Another object of a present invention is capable of laying a shoulder pavement strip which precludes asphalt bleeding when combined with the pavement laid on the roadway proper.

A further object of the present invention is to provide a paving apparatus for roadway shoulders which is fully compatible with existing paving devices and equipment employed in the highway construction field.

The invention possesses other objects and advantages especially as concerns particular characteristics and features thereof which become apparent as the specification continues.

Figure 1:
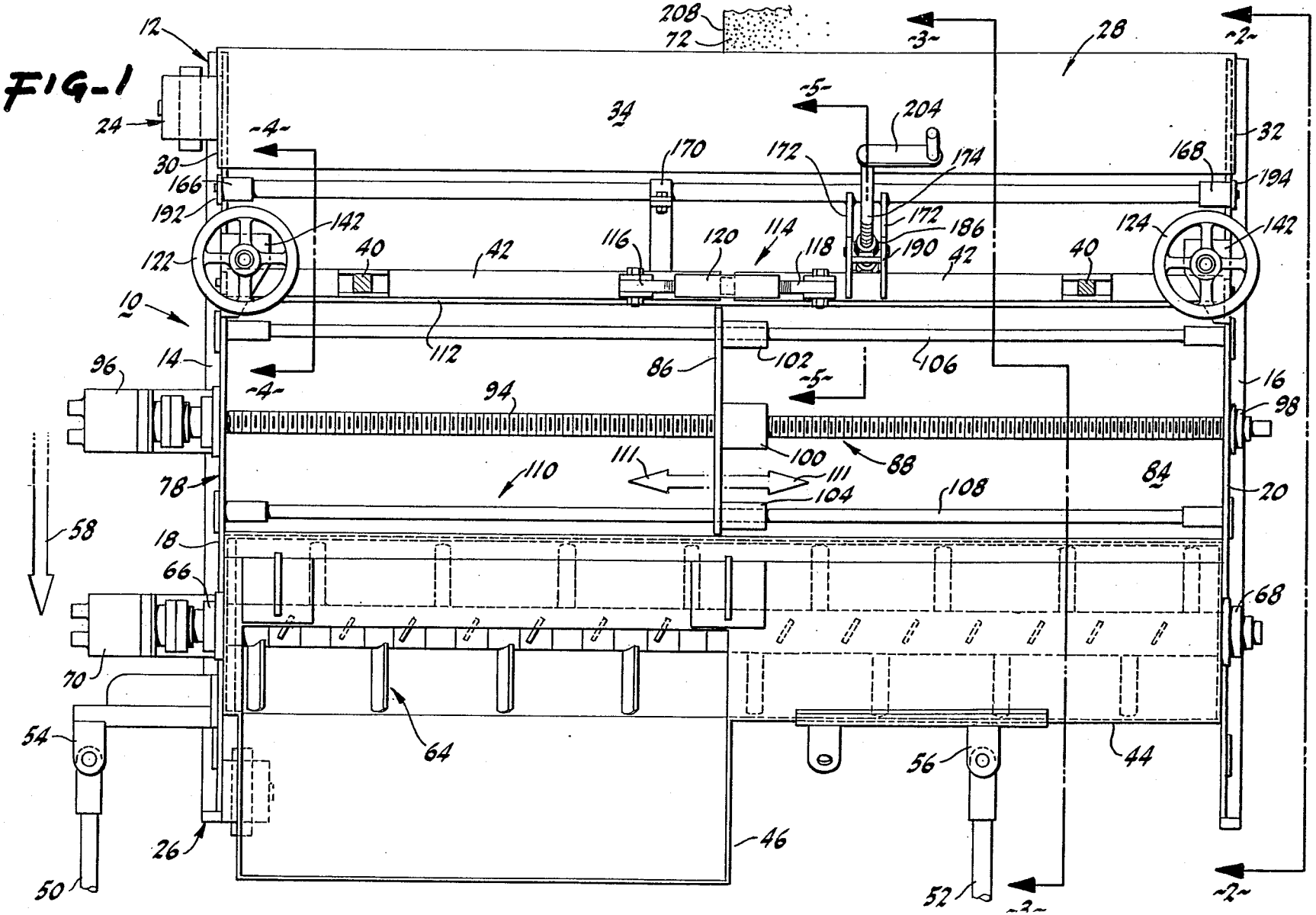
FIG. 1 is a top plan view of the paving apparatus of the present invention.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be referenced to the hereinabove described drawings.

The invention as a whole is shown in the drawings by reference character 10. The paving apparatus 10 includes as one of its elements a carriage 12 which is generally constructed of rigid material such as metal. Carriage 12 includes skids 14 and 16 which are bolted to side plates 18 and 20, respectively, via multiplicity of tabs 22. Wheel mechanisms 24 and 26 are also fixed to carriage 12 adjacent skid 14.

Platform 28 mounts on carriage 12 by the use of flanges 30 and 32 which are fixed to walkway 34 and to plates 18 and 20 by fastening means 36. Platform 28 slides a selected distance above the surface 38 being paved, FIG. 4. Rail 40 extends upwardly from angle member 42 to aide the operator of apparatus and to also serve as a mounting surface for controls (not shown) for motors, which will be heretofore described. It should be noted that upper portion of rail 40 is broken off in FIGS. 1 and 3.

Figure 2:
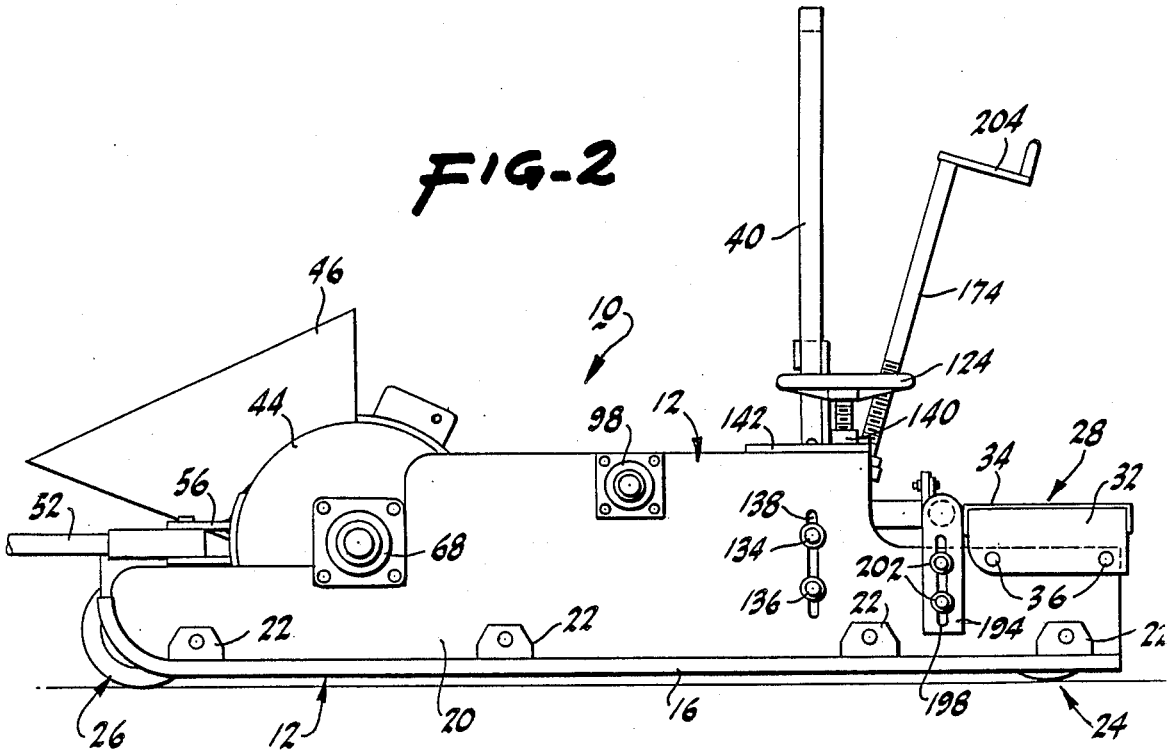
FIG. 2 is side elevation view taken along line 2—2 of FIG. 1
Figure 3:
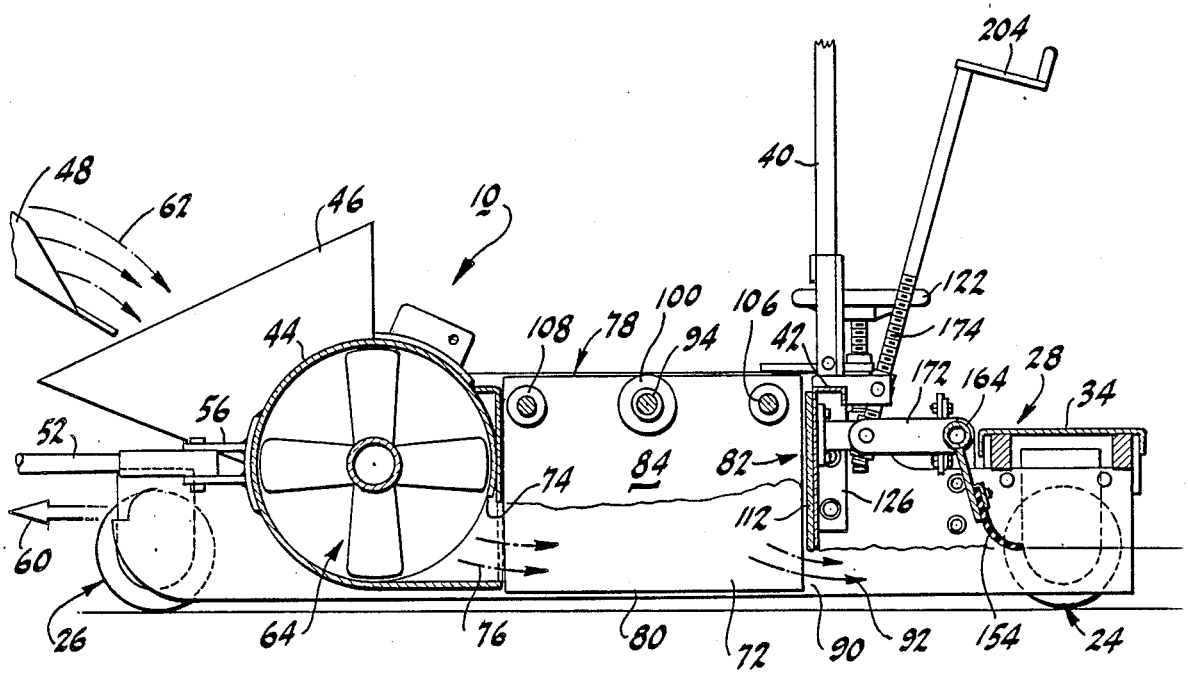
FIG. 3 is a sectional view taken along line 3—3 of FIG. 1.

Turning to FIGS. 2 and 3, in particular, it may be observed that apparatus 10 includes a receiver 44 having hopper 46 which accepts paving material from loading vehicle 48, (partially depicted in FIG. 3). Vehicle 48 may also serve to tow apparatus 10 via shafts 50 and pinioned to arms 54 and 56 extending from carriage 12. Apparatus moves according to directional arrows 58 and 60, FIGS. 1 and 3.

Material entering hopper 46, represented by arcuate arrows 62 of FIG. 3, passes downwardly into auger 64. Auger 64 mounts to plates 18 and 20 and rotates on bearings 66 and 68, thereat. Motor 70, which may be electric or hydraulic, is also mounted to plate 18. Controls, including wires and hoses, have been omitted for the sake of simplicity in the drawings. However, such motor controls may be positioned on rail 40 The turning action of auger 64 generally moves the paving material from hopper 46 along auger 64 away from the motor 70. The paving material 72, FIG. 3, then passes through discharge opening 74 of receiver 44 per arrows 76.

Paving material 72 flowing from opening 74 of receiver 44 passes to a container 78 having a bottom portion 80 and wall portion 82. A chamber 84 is formed by bottom portion 80 and wall portion 82 to hold paving material 72. A partition 86 of wall portion 82 is positioned opposite a portion of plate 20 also forming a part of wall 82. Means 88 is also provided for moving partition 86 which changes the volumetric capacity of chamber 84 and determines the width of exit opening 90 from chamber 84. Directional arrows 92 depict such egress of paving material 72 from chamber 84 the width of such paving material is, of course, ordained by the width of exit 90. Means 88 is shown in the preferred embodiments as including a lead screw 94 which is rotated by electric or hydraulic motor 96 as is the case with motor 70. Motor 96 is also mounted to plate 18. Bearing 98 fixed to plate 20 permits the turning of the end of lead screw 94 opposite motor 96. Partition 86 possesses a threaded block which threadingly engages lead screw 94. Bushings 102 and 104 pass along rods 106 and 108 which span and are supported by plates 18 and 20. Thus, rods 106 and 108 serve as means 110 for guiding the translational motion of partition 86 relative to lead screw 94. In essence, partition 86 may move along container 78 according to directional arrows 112.

The height of paving material 72 exiting container 78 is controlled by a skimmer or screed plate 111. Screed plate 112 is fixed to angle member 42 as depicted in FIG. 1. Screed plate 112 is split into two portions as is the case with angle member 42. Means 114 adjusts the crown on paving material 72 subsequent to leaving opening 90 of container 78. Crown adjustment means 114 includes threaded members 116 and 118 captured by threaded block 120. Threaded members 116 and 118 possess opposite pitches such that the turning of block 120 either separates or brings together threaded member 116 and 118. Threaded members 116 and 118 are mounted to the top of the split portions of angle member 42. Thus, the bottom of split screed plate 112 either forms a slight vee upwardly or downwardly.

Figure 4:
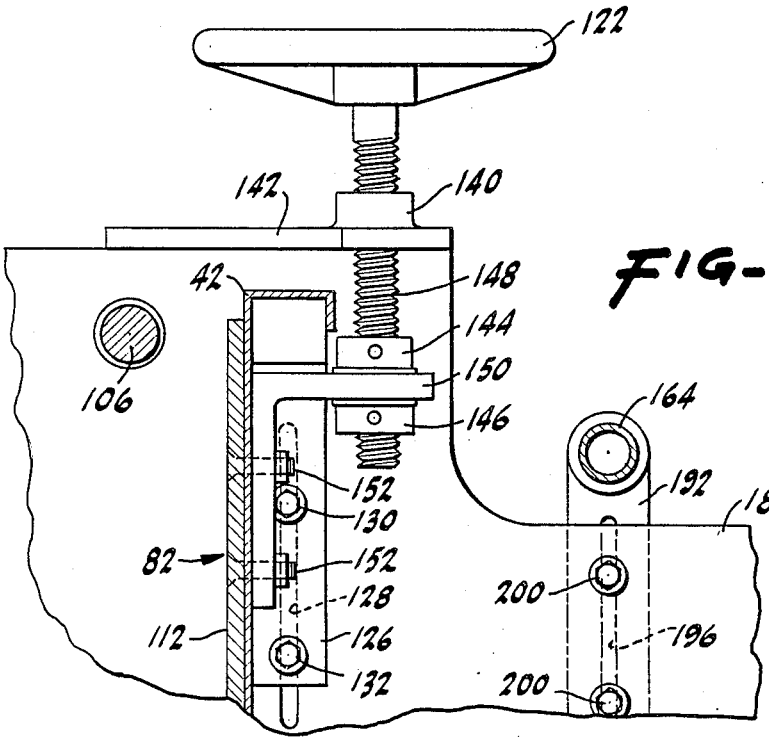
FIG. 4 is a section view taken along line 4—4 of FIG. 1 depicting the screed plate adjustment mechanism.

In addition, ends of screed plate 112 are adjustable upwardly and downwardly, FIG. 4, by control wheels 122 and 124. Angle member 42 is mounted to a plate 126 which lies against side plate 18 of carriage 12. Slot 128 through side plate 18 of carriage 12 accommodates bolts and nuts 130 and 132 which hold plate 126 of angle member 42. The loosening of bolts and nuts 130 and 132 permits angle member 42 and plate 126 to slide vertically. It should be noted that bolts 130 and 132 correspond to bolts and nuts 134 and 136 with regard to slot 138 through plate 20, FIG. 2. Bolts 130 and 132, as well as bolts and nuts 134 and 136 must also be loosened before crown adjustment means 114 may be employed, heretofore described. Threaded boss 140 fixes to plate 142 atop carriage 12. Nuts 144 and 146 are held to the stem 148 of control wheel 122. Nuts 144 and 146 pinion yoke 150 into position around stem 148. Yoke 150 is connected by fastening means 152 to screed plate and angle member 42. Thus, screed plate 112 travels upwardly and downwardly when control wheel 122 is turned. As heretofore mentioned, the same mechanism applies to control wheel 124 and the portion of screed plate 112 linked thereto.

Figure 5:
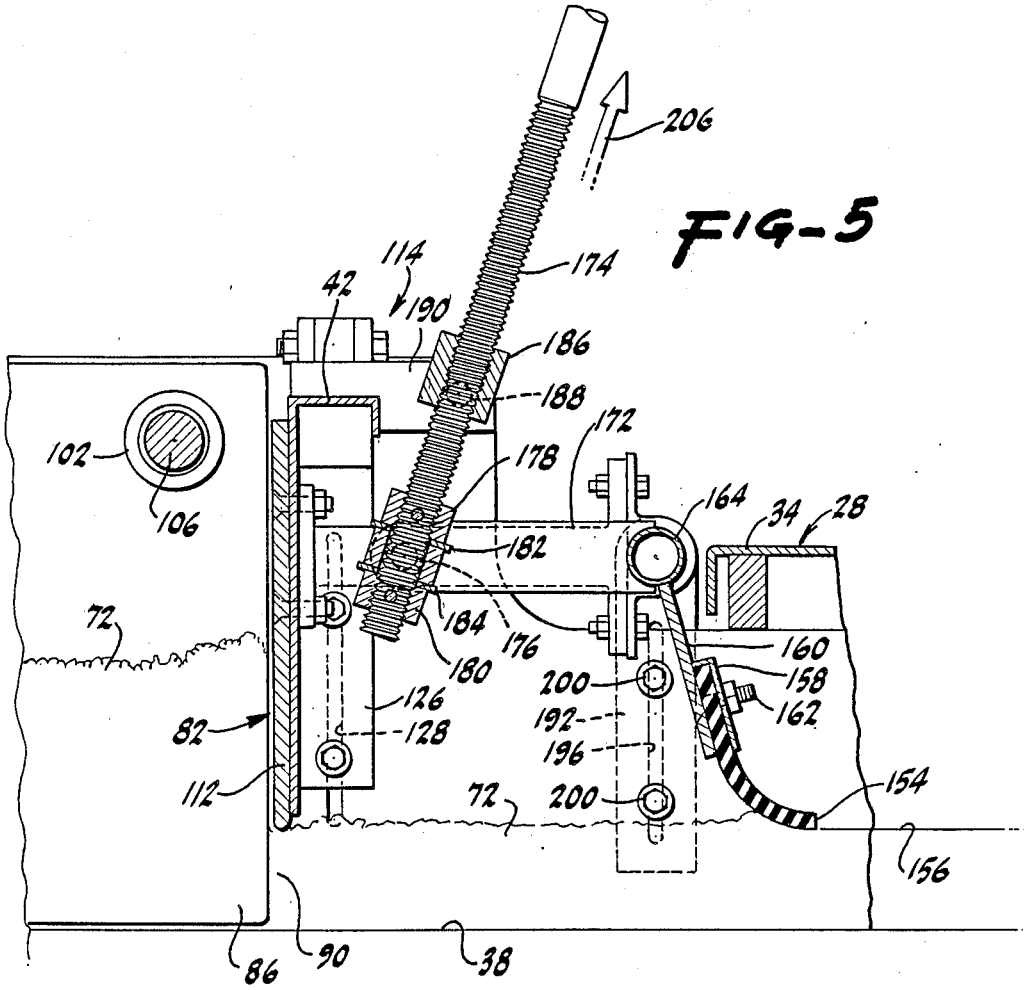
FIG. 5 is a sectional view taken along line 5—5 of FIG. 1 showing the flexible plate adjustment mechanism.

Turning to FIG. 5 it may be observed that flexible plate 154 is also employed to smooth the upper surface 156 of paving material 72. Flexible plate 154 may be a rubberized sheet, a sort of squeegee. Flexible plate 154 nests in a sheath 158 and fastens to paddle 160 by fastening means 162. Paddle 160 is itself linked to rotatable rod 164 supported across carriage 12 by bearings 166, 168 and 170. A pair of fingers 172 are fixed or otherwise connected to rod 164. Finger pair 172 is also fixed to threaded shaft 174 via rod 176, nuts 178 and 180, and is pinioned to threaded shaft 174 in conjunction with shims 182 and 184. Block 186 threadingly engages threaded shaft 174 such that block 186 and threaded shaft 174 rotate about rod 188 with the rotation of the pair of fingers 172 and the paddle 160 about rod 164. Threaded block 186 is held to angle member 42 by the use of parallel plates 190. It should be observed, that bearings 166 and 168 are connected to end plates 192 and 194, respectively. Plates 192 and 194 include slots 196 and 198, respectively. Fasteners 200 and 202 pass through plates 18 and 20 of carriage 12 as well as slots 196 and 198. Thus, the loosening of fasteners 200 and 202 permit rod 164 to be raised and lowered relative to surface 38. Of course, fasteners 200 and 202 must be loosened in conjunction with the fasteners associated with slots 128 and 138 used to adjust screed plate 112.

Crank handle 204 is turned to rotate flexible plate 154 into position above surface 156 of paving material 72. Movement along directional arrow 206, FIG. 5, generally increases the pressure of flexible plate 154 on surface 156 of paving material 72.

In operation, carriage 12 is dragged or otherwise motivated along surface 38 to be paved. Paving material 72 is fed into hopper 46 from loading vehicle 48 and passed into receiver 44. Auger 64 moves the paving material 72 through exit 74 and into a chamber 84 formed in container 78. Movable partition 86 is adjusted by means 88 utilizing motor 96 to turn lead screw 94. Such adjustment would take place when the operator of apparatus 10 is in the vicinity or on top of walkway 34. Thus the edge 208 of paving material 72 passing from apparatus 10 may be very accurately adjusted by use of means 88. As heretofore described, such accurate fixation of edge 208 of paving material 78 permits butt joints between a shoulder being paved by apparatus 10 and the pavement and on the road proper. Normally, the road proper is paved after paving material 72 is laid on top of the shoulder of the roadway. The height of the paving material and exit 90 is adjusted by control wheels 122 and 124 which raise and lower screed plate 112. Likewise, the width of paving material exiting chamber 94 through opening 90 is adjusted by means 88 which positions movable partition 86 within container 78. The surface texture of paving material 72 passing from chamber 84 is smoothed by flexible plate 154. The pressure of flexible plate on the surface 156 of paving material 72 is adjusted by crank handle 204. Means 114 may also be employed to place a crown on paving material 72 by turning block 120.

While in the foregoing embodiments of the present invention have been set forth in considerable detail for the purposes of making complete disclosure of the invention, it may be apparent to those of skill in the art that numerous changes may be made in such detail without departing from the spirit and principles of the invention.

What is claimed is:

1. A paving apparatus movable along a surface to be covered with paving material comprising:

a. a carriage including a surface capable of traveling relative to the surface to be paved;

b. a receiver supported by said carriage for accepting and holding paving material;

c. a container supported by said carriage having a bottom portion and a wall portion extending from said bottom portion forming a chamber, said chamber having an entrance and an exit;

d. a partition forming a portion of said chamber with said wall portion, said partition including means for moving said partition to change the volumetric capacity of said chamber and a dimension of said chamber exit, thereby, during movement of said carriage; and e. means for transporting paving material from said receiver to said container.

2. The paving apparatus of claim 1 in which said means for transporting paving material from said receiver to said container includes a auger disposed in said container.

3. The paving apparatus of claim 1 in which additionally comprises means for regulating the quality of paving material existing said chamber.

4. The paving apparatus of claim 1 which additionally comprises means for determining the surface characteristics of the paving material existing said chamber.

5. The paving apparatus of claim 4 in which said means for determining the surface characteristics of the paving material includes a flexible member and means for pressing said flexible member onto the upper surface of said paving material exiting said chamber.

6. The paving apparatus of claim 1 in which said means for moving said partition to change the volumetric capacity of said chamber includes a lead screw spanning at least a portion of said chamber, said partition threadingly engaging said lead screw, and further includes means for rotating said lead screw.

7. The paving apparatus of claim 6 in which said means for moving said partition further includes means for guiding the motion of said partition relative to said lead screw.

8. The paving apparatus of claim 3 which additionally comprises a platform for supporting an operator of said apparatus.

9. The paving apparatus of claim 8 in which said means for regulating the quantity of paving material exiting said chamber includes a threaded member, a plate having a portion threadingly engaging said threaded member and means for manually turning said threaded member accessible from said platform.

10. The paving apparatus of claim 9 in which said means for determining the surface characteristics of the paving material exiting said chamber includes a threaded member, a flexible plate rotatable on a bar supported to said carriage, said bar including a portion threadingly engaging said threaded member, and means for manually turning said threaded member accessible from said platform.

* * * * *